US007219628B1

(12) United States Patent
Krishnamurthy et al.

(10) Patent No.: US 7,219,628 B1
(45) Date of Patent: May 22, 2007

(54) VAPORIZER AND METHODS RELATING TO SAME

(75) Inventors: Balaji Krishnamurthy, Katy, TX (US); Peter D. Smith, Ipswich, MA (US); Boris S. Lazebnik, Needham, MA (US); Jeffery D. Baldic, Andover, MA (US); David P. Bloomfield, Boston, MA (US)

(73) Assignee: Texaco Inc., San Ramon, CA (US)

( * ) Notice: Subject to any disclaimer, the term of this patent is extended or adjusted under 35 U.S.C. 154(b) by 169 days.

(21) Appl. No.: 10/991,596

(22) Filed: Nov. 17, 2004

(51) Int. Cl.
*F28D 15/04* (2006.01)

(52) U.S. Cl. ..... 122/336; 165/104.26

(58) Field of Classification Search ..... 122/366; 165/104.26, 104.11, 104.24, 104.31
See application file for complete search history.

(56) References Cited

U.S. PATENT DOCUMENTS

| | | | | |
|---|---|---|---|---|
| 804,973 | A | | 11/1905 | Poplawski |
| 2,742,024 | A | | 4/1956 | Oberdier |
| 3,275,074 | A | | 9/1966 | Campbell et al. |
| 3,384,154 | A | | 5/1968 | Millon |
| 3,789,920 | A | | 2/1974 | Low et al. |
| 3,971,435 | A | | 7/1976 | Peck |
| 3,977,364 | A | | 8/1976 | Gijsbers et al. |
| 4,057,963 | A | * | 11/1977 | Basiulis ..... 60/641.7 |
| 4,116,266 | A | * | 9/1978 | Sawata et al. ..... 165/104.26 |
| 4,419,302 | A | | 12/1983 | Nishino et al. |
| 4,492,266 | A | | 1/1985 | Bizzell et al. |
| 4,602,679 | A | | 7/1986 | Edelstein et al. |
| 5,145,001 | A | | 9/1992 | Valenzuela |
| 5,267,611 | A | | 12/1993 | Rosenfeld |

(Continued)

OTHER PUBLICATIONS

Stedman, J.K., et al., *High Power Density Fuel Cell*, Technical Report AFAPL-TR-69-106, Jan. 1970, pp. 23-25.

*Primary Examiner*—Gregory Wilson
(74) *Attorney, Agent, or Firm*—Frank C. Turner; Melissa Patangia

(57) ABSTRACT

An apparatus for vaporizing a liquid and heating the vaporized liquid to an elevated temperature. The apparatus has a heat transfer wall having an outer surface for receiving heat and transferring the heat to an inner surface. A wick material is disposed so that a portion of the wick material is in contact with the inner surface and another portion is remote from the heat transfer wall. A wick support in contact with the wick material opposite the inner surface of the heat transfer wall provides structural support to the wick material and further provides a path for vaporized liquid to flow from the wick material. Vaporizable liquid is delivered to the portion of the wick material that is remote from the heat transfer wall and is allowed to migrate to the portion that is in contact with the inner surface. Heat from the inner surface converts the liquid to a vaporized liquid. Optionally, a gaseous fuel may be introduced into the wick support for pre-heating and mixing with the vaporized liquid. Vaporized liquid flows out of the wick material through the wick support and into a downstream superheater that preferably houses a heat exchange device. The heat exchange device is in thermal communication with the inner surface of the heat transfer wall for receiving and transferring heat to the vaporized liquid. The apparatus can include multiple vaporization units connected to common and/or different heat sources. Methods for making an apparatus for vaporizing a liquid and methods for vaporizing a liquid are also disclosed.

33 Claims, 5 Drawing Sheets

U.S. PATENT DOCUMENTS 5,303,768 A 4/1994 Alario et al.
5,602,958 A 2/1997 Vergnes
5,692,095 A 11/1997 Young
5,771,845 A 6/1998 Pistien et al.
5,771,967 A * 6/1998 Hyman ..... 165/274
6,169,852 B1 1/2001 Liao et al.
6,203,587 B1 3/2001 Lesieur et al.
6,241,008 B1 6/2001 Dunbar
6,397,936 B1 * 6/2002 Crowley et al. ..... 165/104.26
6,450,132 B1 * 9/2002 Yao et al. ..... 122/366
6,634,864 B1 10/2003 Young et al.

* cited by examiner

VAPORIZER AND METHODS RELATING TO SAME

FIELD OF THE INVENTION

The present invention relates to the field of vaporizers, boilers and heat exchanging devices that are used to convert liquids to gases at elevated temperatures. More specifically, the apparatus and methods of the present invention can be used to generate a high quality high temperature steam for use in a variety of applications including, but not limited to, fuel processing applications.

BACKGROUND OF THE INVENTION

Vaporizing liquid, especially the vaporization of water, is a very common technology. The traditional approach to vaporizing water involves heating a pool of water to its boiling temperature and capturing the vapor that evolves from the liquid. A common vaporization technology uses shell and tube-type boiler designs. In the case of smaller shell and tube-type boilers, the water to be vaporized resides in the spaces around heat exchange tubes. In the case of larger shell and tube-type boilers, the water flows internally through heat exchange tubes that are heated by heat external to the tubes.

The inability to generate steam quickly in response to demand is common to most conventional boiling technologies. For quick start applications, conventional boilers must be maintained in a hot stand-by mode. Other disadvantages of conventional boiler technologies can include the large thermal mass of liquid water that contributes to slow responses to transients, limited ability to thermally integrate the boiler with multiple heat streams or heat sources, and limited ability to utilize the boiler for heating materials other than the liquid to be vaporized.

In addition, another well known disadvantage associated with conventional boilers is the occurrence of liquid carry-over or slugging, wherein non-vaporized liquid is carried over with the vaporized liquid. Where the vaporized product required is a high quality steam, means must be employed to separate and remove the non-vaporized liquid from the steam. Means that are commonly employed to remove such carry-over from steam include knock-out or steam drums. However, for a system that utilizes a knock-out drum, the start-up time required to begin producing the vapor product is heavily dependent upon the size of the knock-out drum, and such times can range up to several hours. Further, means required to separate and remove liquid components from vaporized liquid will increase the size, cost and complexity of the vaporization apparatus.

SUMMARY OF THE INVENTION

In one aspect of the instant invention, an apparatus for vaporizing a liquid and heating the vaporized liquid to an elevated temperature is provided. The apparatus includes at least one heat transfer wall having an inner surface and an outer surface that is capable of receiving heat and transferring the heat to the inner surface. A wick material is included for receiving a vaporizable liquid and directing the liquid to the inner surface of the heat transfer wall. At least a portion of the wick material is in contact with the inner surface of the heat transfer wall, preferably an upstream portion of that inner surface. The wick material can include fibers, such as alumina fibers, in a woven or non-woven fabric that is capable of conducting liquid to the inner surface. A wick support is included that is in contact with the wick material opposite the inner surface and provides a path for a vaporized liquid to flow from the wick material. The wick support can include an extended surface area such as a corrugated metal fin. A superheater is disposed downstream of the wick support that is in fluid communication with the wick support for receiving vaporized liquid and for heating the vaporized liquid to an elevated temperature. The superheater can include a heat conductor, such as a corrugated metal fin, for conducting heat from the inner surface of the heat transfer wall to the vaporized liquid. In some embodiments, at least one heat transfer wall can comprise two planar heat transfer walls spaced apart from one another with the wick support, wick material and superheater disposed between the two planar walls.

An apparatus can optionally include a heat source for providing heat to the outer surface of at least one heat transfer wall. An optional heat source can include a radiant heat source and/or one or more of a burner or reforming reactor for providing a flow of heated fluid to the outer surface of the heat transfer wall. A heat conductor can be provided in contact with at least a portion of the outer surface of the heat transfer wall opposite the wick material for conducting heat to the outer surface. Such a heat conductor can comprise a corrugated metal fin. An outer wall spaced apart from the outer surface of the heat transfer wall can be included for providing a path therebetween for a flow of a heated fluid capable of delivering heat to the outer surface. The heat transfer wall and the outer wall can each comprise a cylindrical wall or planar wall. Liquid delivery means can optionally be included for delivering liquid to the wick material. The liquid delivery means can include a source of liquid and a pump. A vapor outlet can be provided in fluid communication with the superheater for removing vaporized liquid at an elevated temperature from the apparatus.

In another aspect of the present invention, an apparatus for vaporizing a liquid is provided. The apparatus includes a plurality of vaporization units. Each vaporization unit includes a liquid inlet and a wick material for receiving a vaporizable liquid from the liquid inlet and directing the liquid to a heat transfer wall. The heat transfer wall has an inner surface and an outer surface that is capable of receiving heat and transferring the heat to the inner surface. At least a portion of the inner surface of the heat transfer wall is in contact with the wick material. Each vaporization unit includes a wick support in contact with the wick material opposite the inner surface of the heat transfer wall that provides a path for vaporized liquid to flow from the wick material. A superheater is disposed downstream of the wick support that is in fluid communication with the wick support for receiving vaporized liquid and heating the vaporized liquid to an elevated temperature. Each vaporization unit includes a vapor outlet in fluid communication with the superheater. The apparatus includes a heat source inlet manifold capable of providing a flow of a heated fluid to the outer surface of the heat transfer wall(s) of one or more of the vaporization units and an outlet manifold capable of directing the flow of heated fluid out of the one or more vaporization units. Optionally, the apparatus can include a second heat source inlet manifold capable of providing a flow of a second heated fluid to one or more of the vaporization units and a second outlet manifold for directing the flow of the second heated fluid out of the one or more vaporization units. The apparatus can include liquid delivery means for delivering liquid to the liquid inlets that comprises a source of liquid, a pump, and metering means for delivering a uniform flow of liquid to the liquid inlets.

In a process aspect of the invention, a method for making an apparatus for vaporizing a liquid is provided. The method includes the steps of overlaying a wick material over at least an upstream portion of a wick support having an extended surface area, placing a heat conductor adjacent a downstream portion of the wick support, and enclosing the wick support, wick material and heat conductor with at least one heat transfer wall. The heat transfer wall(s) has an inner surface and an outer surface and a portion of the wick material is in contact with an upstream portion of the inner surface and the heat conductor is adjacent a downstream portion of the inner surface when the wick support, wick material and heat conductor are enclosed. Optionally, the method can further include providing an opening in the wick material for introducing a gas into the wick support. A second heat conductor can optionally be disposed adjacent the outer surface of the heat transfer wall. The method can further include one or more of the following optional steps: selecting an anticipated flow rate at which the wick material is to receive a vaporizable liquid; providing a wick material capable of receiving an anticipated flow of vaporizable liquid remote from at least one heat transfer wall and conducting the vaporizable liquid to a portion of the wick material in contact with at least one heat transfer wall; and/or selecting material(s) for the at least one heat transfer wall, wick material and/or wick support that will provide a heat transfer coefficient capable of transferring sufficient heat from the outer surface to the inner surface to vaporize an anticipated flow of vaporizable liquid so that non-vaporized liquid is prevented from contacting the heat conductor; and providing sufficient contact area between the wick material and the inner surface of the heat transfer wall to vaporize an anticipated flow of vaporizable liquid so that non-vaporized liquid is prevented from contacting the heat conductor.

In another process aspect of the present invention, a method for vaporizing a liquid is provided. The method includes the steps of providing heat to an outer surface of a heat transfer wall that is capable of transferring heat from the outer surface to an inner surface for vaporizing a vaporizable liquid and for heating a vaporized liquid to an elevated temperature; delivering a vaporizable liquid to a portion of a wick material remote from the heat transfer wall, the wick material conducting the vaporizable liquid to a portion of the wick material in contact with the inner surface of the heat transfer wall where the vaporizable liquid is heated to produce a vaporized liquid; providing contact between the vaporized liquid and a heat conductor that is in thermal communication with the inner surface of the heat transfer wall to heat the vaporized liquid to an elevated temperature. Heat can be provided to the outer surface of the heat transfer wall in sufficient quantity to vaporize the vaporizable liquid and prevent non-vaporized liquid from contacting the heat conductor. Heat can be provided to the outer surface of the heat transfer wall by one or more of contact with a flow of heated fluid and/or receiving heat from a radiant heat source. The flow of heated fluid can include one or more of burner exhaust and/or hot reformate and the flow of heated fluid along the heat transfer wall can be counter to the flow of vaporized liquid. The method can further include mixing a fuel with the vaporized liquid to provide a mixture of heated fuel and vaporized liquid. Fuel can be mixed with the vaporized liquid by introducing the fuel into the wick support. In a preferred embodiment, the vaporizable liquid comprises water.

BRIEF DESCRIPTION OF THE DRAWINGS

The invention may be understood by reference to the following description taken in conjunction with the accompanying drawings.

Figure 1:
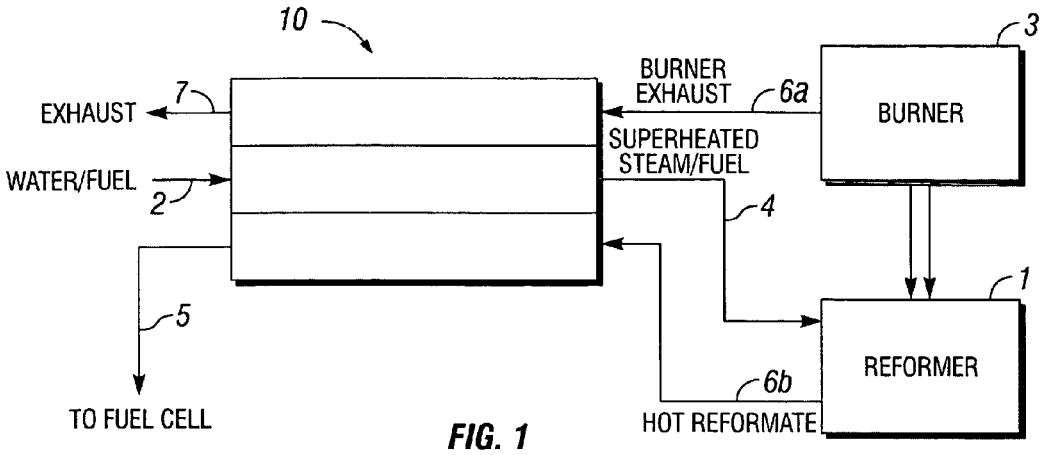
FIG. 1 is a schematic illustrating a fuel processing system wherein an apparatus of the present invention capable of generating a high temperature steam/fuel mixture feed for a reforming reactor is utilized.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Illustrative embodiments of the invention are described below. In the interest of clarity, not all features of an actual embodiment are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover it will be appreciated that such a development effort might be complex and time-consuming, but would nevertheless be a routine undertaking for those of ordinary skill in the art having the benefit of this disclosure.

An apparatus of the present invention is for vaporizing a liquid and heating the vaporized liquid to an elevated temperature. As used in this disclosure, "elevated temperature(s)" is intended to refer to those temperatures above the vaporization temperature or boiling point of the vaporizable liquid. In addition, the following description sometimes refers to water as an example of the vaporizable liquid that can be vaporized in the apparatus of the present invention. While steam generation is an application of the technology of the present invention, one of skill in the art will recognize that the scope of the claimed invention is not so limited.

A vaporization apparatus of the present invention is compact and thermally efficient. The apparatus can be easily integrated into a system so as to provide needed vaporized liquid, but can also utilize heat from multiple heat sources to improve the thermal efficiency of the system as a whole. In addition, a vaporization apparatus of the present invention is capable of pre-heating gas(es) and mixing them with the vaporized liquid for use in applications where mixtures of heated gases are required. Moreover, a vaporization apparatus of the present invention has a short start-up time enabling the apparatus to generate high quality vaporized liquid rapidly in response to demand.

An apparatus of the present invention comprises at least one heat transfer wall having an inner surface and an outer surface. The outer surface of the heat transfer wall receives heat from a heat source such as a radiant heat source or from a flow of a heated fluid in contact with the outer surface. Heat received at the outer surface is transferred to the inner surface where it is used to vaporize a vaporizable liquid or superheat a vaporized liquid. The heat transfer wall(s) will preferably be elongated having upstream and downstream portions. In this regard, the relative terms "upstream" and "downstream" are in reference to the general direction of flow of the vaporized liquid through the wick support and superheater. In some embodiments at least one heat transfer wall is cylindrical in shape while in others, the wall is planar in form. Further, the apparatus of the present invention will comprise at least one heat transfer wall, but in some embodiments will comprise two or more heat transfer walls. For instance, where the heat transfer walls are planar in nature, the wick support and superheater are preferably disposed between two planar heat transfer walls.

The heat transfer wall(s) can be fabricated from any material or combination of materials that is capable of withstanding the operating conditions and chemical environment described herein. For instance, the outer surface of the heat transfer wall may be selected to transfer heat from a flow of burner exhaust at temperatures up to about 1000° C. or higher. Moreover, the heat transfer walls should be fabricated from a material or combination of materials that will enable the vaporization of the anticipated flow of vaporizable liquid and the superheating of the vaporized fluid to a desired elevated temperature. Thermally conductive materials capable of transferring suitable quantities of heat are well known and are commonly used in heat exchange applications. More specifically, materials suitable for use in fabricating the heat transfer wall(s) can include, for example, aluminum, stainless steel, copper, nickel, chromium, iron, alloys of the same, and like. In addition, it is preferred that the heat transfer wall(s) be fabricated from gas impermeable material(s) so that vaporized liquid and/or gases are prevented from migrating across the wall.

The size of the heat transfer wall will depend on the surface area of the inner surface of the heat transfer wall that is needed to vaporize a desired quantity of vaporizable liquid in the wick material and to superheat the vaporized liquid to a desired temperature in the superheater. These surface areas can be determined from the vaporization temperature of the vaporizable liquid, the heat transfer coefficients of the wick and superheating sections, and the temperature and quantity of the heat supplied to the outer surface of the heat transfer wall(s) among other factors.

The apparatus of the present invention includes a wick material capable of receiving and conducting a vaporizable liquid to the inner surface of the heat transfer wall. Migration of the vaporizable liquid through the wick material from one region or portion to another can be driven by capillary action and/or a siphon effect. At least a portion of the wick material is in contact with the inner surface of the heat transfer wall so that the vaporizable liquid conducted to that portion of the wick material is heated to its vaporization temperature to produce a vaporized liquid at that heat transfer surface. Preferably, the portion of the wick material in contact with the inner surface of the heat transfer wall is in contact with an upstream portion of the inner surface.

The wick material can also have a portion that is remote from the heat transfer wall for receiving a vaporizable liquid from a liquid inlet, manifold or other liquid delivery means. When the apparatus is to be used to pre-heat and/or mix a gas with the vaporized liquid, one or more openings can be provided in the wick material for gas to be introduced directly into the wick support. A portion(s) of the wick material that is in contact with the heat transfer wall is sometimes referred to herein as a "side" portion. A portion of the wick material that is remote from the heat transfer wall is sometimes referred to as a "top" portion. In an embodiment where the apparatus comprises a pair of spaced apart planar heat transfer walls, a planar wick material may be positioned over a planar wick support so that when assembled, the side portions of the wick material are disposed between the wick support and the inner surfaces of the heat transfer walls and the top portion of the wick material is disposed over an edge of the wick support intermediate and bridging the side portions.

Wick materials are known and commonly used in the humidifier and evaporator arts. Wick materials known for such applications are suitable for use as the wick material in an apparatus of the present invention provided that such materials are not readily degraded or deactivated by the high temperature environment of the apparatus. Examples of suitable wick materials include porous and open celled foam materials as well as fibrous materials in woven and non-woven fabrics capable of wicking or conducting liquid. Suitable woven wick materials can have a uniform weave pattern and gauge, but can also comprise wovens having multiple layers, weave patterns and/or gauges. Specific examples of suitable fibrous wick materials can include one or more of inorganic fibers such as glass, silica, alumina, ceramics and metals, and organic fibers capable of withstanding the internal temperatures of the apparatus. In a preferred embodiment, the wick material comprises a fabric of alumina fibers that is sufficiently flexible that the material may be folded, creased or rolled into a desired configuration such as for folding over a wick support or rolling into a cylinder around a wick support. Such alumina materials are well known and commercially available.

An apparatus of the present invention further comprises a wick support in contact with the wick material opposite the inner surface of the heat transfer wall. The wick support provides structural support to the wick material, ensures contact between a portion of the wick material and the inner surface, and provides a path for vaporized liquid to flow from the wick material to a superheater disposed downstream. As such, the wick support should be sufficiently rigid to provide needed structural support but preferably also flexible enough to allow the support to be flexed or rolled into a desired shape. For certain configurations, such as when the wick support is to be rolled into a cylindrical configuration, the wick support should also have a degree of resiliency so that it may be used to urge the wick material into contact with the inner surface of the heat transfer wall. In addition, the wick support can also be used to transfer heat to the vaporized liquid and any gas(es) that may be introduced into the wick support for pre-heating and mixing with the vaporized liquid. As such, the wick support preferably has an extended surface area for contacting the vaporized liquid and gas(es) and can be fabricated from heat exchanger materials as are described herein. In a preferred embodiment, the wick support comprises a corrugated metal fin. Suitable metal fins typically comprise aluminum and/or some other highly heat conductive metal(s). Such materials are commercially available from suppliers active in the field of heat exchangers, such as Robinson Fin Machines, Inc. of Kenton, Ohio.

Sufficient contact area should be provided between a portion of the wick material and the inner surface of the heat transfer wall so that the vaporization rate prevents non-vaporized liquid from passing through the wick support and contacting the superheater located downstream. Further, the vaporization rate should be sufficient to produce a desired flow of vaporized liquid. The amount of contact area between the wick material and the heat transfer wall(s) will depend on the vaporization temperature of the liquid to be vaporized, the heat transfer coefficient, and the temperature and quantity of the heat supplied to the outer surface of the heat transfer wall(s) among other factors.

The contact area between the wick material and the inner surface of the heat transfer wall can be determined from the general formula:

$$Q_{wick}=U_{wick}A\Delta T_{LMTD}$$

where $Q_{wick}$ is the heat required to vaporize the vaporizable liquid in the wick material, $U_{wick}$ is the heat transfer coefficient, A is the contact area and $\Delta T_{LMTD}$ is the logarithmic mean temperature difference. Where the vaporizable liquid is water to be converted to steam, the heat transfer coefficient for the wick material and wick support should be between about 2500 and about 100,000 $W/m^2/K$. However, this formula assumes that only vaporization will be occurring in the portion of the apparatus that contains the wick material. In some embodiments, it is desirable for both vaporization and pre-heating to occur within the wick material and wick support. In such an embodiment, the wick material and contact area between the wick material and heat transfer wall will be oversized and the heat transfer coefficient for this oversized contact area will include a vaporization component and a component associated with heating a gas. Therefore, it is preferred that the selection of the contact area as well as the selection of materials for the heat transfer wall, wick material and wick support also take into account the heat transfer coefficient applicable to the heating of the vaporized liquid to an elevated or superheated temperature. Such a heat transfer coefficient is described in connection with the superheater below.

An apparatus of the present invention will further comprise a superheater disposed downstream of the wick support that is in fluid communication with the wick support for receiving a flow of vaporized liquid. A primary function of the superheater is to heat the vaporized liquid to an elevated or superheated temperature. The superheater is in thermal communication with a downstream portion of the inner surface of the heat transfer wall and can comprise a heat conductor for contacting and heating the vaporized liquid to an elevated temperature. The heat conductor is preferably fabricated from highly heat conductive metal(s), such as aluminum, and has an extended surface area for conducting and transferring heat to the vaporized liquid. Suitable heat conductors preferably comprise a corrugated metal fin such as are commercially available from suppliers in the field of plate-type heat exchangers.

The maximum temperature of the superheated vapor that can be generated in an apparatus of the present invention is largely dependent on the temperature of the heat that is delivered to the outer surface of the heat transfer wall and the heat transfer coefficients. The superheater has a heat transfer coefficient that differs from the heat transfer coefficient associated with the wick material and wick support because no vaporization is to occur within the superheater. The heat transfer coefficient of the superheater can be used to determine the surface area of heat transfer wall that is required to elevate a quantity of vaporized liquid to a desired elevated temperature. More specifically, the surface area of the heat transfer wall associated with the superheater can be determined from the general formula:

$$Q_{supheat}=U_{supheat}A\ \Delta T_{LMTD}$$

where $Q_{supheat}$ is the heat required to elevate the temperature of the vaporized liquid to a desired temperature in the superheater, $U_{supheat}$ is the heat transfer coefficient, A is area, and $\Delta T_{LMTD}$ is the logarithmic mean temperature difference. Where the vaporized liquid is steam to be converted to superheated steam, the heat transfer coefficient for the superheater should be between about 25 and about 250 $W/m^2/K$.

The temperature difference between the heat stream that is fed to the apparatus and the superheated vapor that exits the apparatus is sometimes referred to as the pinch temperature. Pinch temperatures can be used as an indicator of heat exchange efficiency. In an apparatus of the present invention, pinch temperatures of less than about 24° C. have been observed. However, it is envisioned that the apparatus can be modified for achieving higher or lower pinch temperatures as desired without departing from the scope of the invention.

A heat conductor in thermal communication with at least a portion of the outer surface of the heat transfer wall can optionally be used to receive/absorb heat from a variety of heat sources and conduct the heat to the heat transfer wall. Preferably, the heat conductor is in contact with the outer surface of the heat transfer wall and can be disposed opposite the wick material and/or superheater. Preferably, the heat conductor has an extended surface area for receiving/absorbing heat such as may be provided by a corrugated metal fin. Suitable heat conductors can be fabricated from highly heat conductive metal(s), such as aluminum, and are commercially available from suppliers in the field of plate-type heat exchangers.

An apparatus of the present invention can optionally include a heat source, such as a radiant heat source, for providing heat to the outer surface of at least one heat transfer wall. Radiant heat sources can include electrical heating elements positioned adjacent or in contact with the outer surface of the heat transfer wall(s). Other optional heat sources can include process units that generate streams of heated fluid(s) that may be directed to the outer surface(s) of the heat transfer wall(s) and/or a heat conductor in thermal communication with such wall(s). By way of example, such heat generating units can include burners and combustors that produce hot exhaust gases, and reactors such as reforming reactors that produce hot reformate or other hot reaction products. Other heat generators or sources of heat may be used to provide heat to the outer surface of the heat transfer wall(s) without departing from the scope of the present invention.

In some embodiments, an apparatus of the present invention can comprise an outer wall spaced apart from the outer surface of the heat transfer wall. The space defined between such an outer wall and the outer surface of a heat transfer wall can serve as a path for a flow of heated fluid along the outer surface of the heat transfer wall. Preferably, when an outer wall is present, it will have a similar shape and size as the heat transfer wall. For instance, where the heat transfer wall is cylindrical, it is preferred that the outer wall be cylindrical and concentric with the heat transfer wall although having a larger diameter. Where the heat transfer wall is planar in nature, the outer wall is preferably planar as well.

A liquid inlet can be provided for directing a vaporizable liquid to the wick material. Liquid delivery means can also optionally be included for delivering liquid to the wick material, that can comprise a source of liquid, a pump and metering means capable of providing a uniform flow of liquid to the liquid inlet can also be included. A vapor outlet in fluid communication with the superheater for removing vaporized liquid at an elevated temperature from the apparatus can also be provided. In addition, ports for thermocouples and other temperature sensing devices may be used at various locations on the apparatus.

In another embodiment, an apparatus of the present invention can comprise a plurality of vaporization units. In such an embodiment, each vaporization unit comprises a liquid inlet and a wick material for receiving a vaporizable liquid from the liquid inlet and conducting the liquid to at least one heat transfer wall. At least one heat transfer wall has an inner surface and an outer surface with the outer surface capable of receiving heat and transferring the heat to the inner surface. At least a portion of the inner surface of the heat transfer wall is in contact with wick material where vaporization is to occur. In addition, each vaporization unit comprises a wick support in contact with the wick material opposite the inner surface. The wick support provides a path for vaporized liquid to flow out of and away from the wick material. Each vaporization unit will also include a superheater that is disposed downstream of the wick support. The superheater is in fluid communication with the wick support and is capable of receiving a flow of vaporized liquid from the wick support and heating the vaporized liquid to an elevated temperature. Each vaporization unit further includes a vapor outlet in fluid communication with the superheater. A description of each of these features is provided elsewhere in this disclosure and need not repeated here.

In addition to the plurality of vaporization units, such an apparatus will further comprise a heat source manifold capable of providing a flow of heated fluid to the outer surface of one or more of the plurality of vaporization units. The heat source manifold can include a diverter for dividing a heat stream into two or more streams for direction to two or more vaporization units. Likewise, such an apparatus will further comprise an outlet manifold capable of directing flow(s) of heated fluid out of the one or more of the plurality of vaporization units.

As described in association with the accompanying drawings, adjacent vaporization units can be spaced apart from one another so that there is a path formed between the heat transfer walls of the adjacent units for the flow of heat to the outer surfaces of the adjacent heat transfer walls. Further, a heat conductor can be provided in such a path for conducting heat to the outer surfaces of those heat transfer walls. Where a particular vaporization unit does not have an adjacent vaporization unit, an outer wall as described herein can be used to provide a path for heat to flow along the outer surface of the heat transfer wall. Similarly, a heat conductor can be provided in such a path for conducting heat to the outer surface of that heat transfer wall.

In some embodiments, an apparatus comprising a plurality of vaporization units can comprise a second heat source inlet manifold capable of providing a flow of a second heated fluid to one or more of the plurality of vaporization units and a second outlet manifold for directing the flow of the second heated fluid out of the one or more of the plurality of vaporization units. The capability of an apparatus of the present invention to utilize two or more heat streams promotes thermal efficiencies not only in terms of the generation of superheated vapor by the apparatus, but also in terms of system-wide efficiencies when heat from multiple heat-generating components can be utilized.

In still other embodiments, an apparatus comprising a plurality of vaporization units can comprise liquid delivery means capable of delivering a vaporizable liquid to the liquid inlets of the plurality of vaporization units. Liquid delivery means will preferably comprise a source of liquid, a pump and metering means for delivering a uniform flow of liquid to the liquid inlets of the vaporization units.

A particular advantage of the present invention is found in the ease of manufacturing a vaporization apparatus. As a result, in a process aspect of the present invention a method for making an apparatus for vaporizing a liquid is provided. The method comprises the steps of overlaying or placing a wick material over at least an upstream portion of a wick support having an extended surface area. As noted above, the wick material should be sufficiently flexible that the material can be folded or creased and laid over the wick support. When the apparatus is to have a general cylindrical shape, the wick material is rolled into a cylinder around a cylindrical wick support prior to inserting the wick and wick support into a cylindrical heat transfer wall. In such an embodiment, the wick support should be closely sized and configured to the inner diameter of the heat transfer wall and/or be sufficiently resilient that the wick support provides a compressive force against the wick material to ensure contact between the wick material and the heat transfer wall. When the apparatus is planar in nature, the wick material can be folded over one edge of the wick support so that the wick material forms two side portions that extend substantially over the extended surface area of the wick support and a top portion that bridges the two side portions and covers the edge of the wick support. The method further comprises placing a heat conductor adjacent a downstream end of the wick support so that it is in fluid communication with the wick support. The wick support, wick material and heat conductor are then enclosed with at least one heat transfer wall having an inner surface so that when enclosed, a portion of the wick material is in contact with an upstream portion of the inner surface and the heat conductor is adjacent a downstream portion of the inner surface.

The method of making a vaporization apparatus can further include one or more of the steps of (a) selecting an anticipated flow rate at which the wick material is to receive a vaporizable liquid, (b) providing a wick material capable of receiving an anticipated flow of vaporizable liquid remote from at least one heat transfer wall and conducting the vaporizable liquid to a portion of the wick material in contact with at least one heat transfer wall, (c) selecting material(s) for at least one heat transfer wall, wick material and/or wick support that will provide a heat transfer coefficient capable of transferring sufficient heat from the outer surface to the inner surface to vaporize an anticipated flow of vaporizable liquid so that non-vaporized liquid is prevented from contacting the heat conductor; and (d) providing sufficient contact area between the wick material and the inner surface to vaporize an anticipated flow of vaporizable liquid so that non-vaporized liquid is prevented from contacting the heat conductor. Optionally, the method of making a vaporization apparatus can further include disposing a second heat conductor adjacent the outer surface of at least one heat transfer wall capable of conducting heat to an outer surface of the heat transfer wall. Moreover, the method can further include providing an opening in the wick material for introducing a gas into the wick support for preheating and mixing the gas with vaporized liquid.

In another embodiment of the present invention, a method for vaporizing a liquid is provided. The method includes the step of providing heat to an outer surface of a heat transfer wall that is capable of transferring the heat from the outer surface to an inner surface for use in vaporizing a vaporizable liquid and for heating the vaporized liquid to an elevated temperature. Preferably, the heat will be provided to the outer surface of the heat transfer wall in sufficient quantity to vaporize the vaporizable liquid and prevent non-vaporized liquid from contacting a heat conductor disposed downstream. Heat can be provided to the outer surface of the heat transfer wall by one or more of contact with a flow of heated fluid and/or receiving heat from a radiant heat source. When heat is delivered to the outer surface of the heat transfer wall by a flow of heated fluid, the heat fluid can comprise one or more of burner exhaust and/or hot reformate. Preferably, the flow of heated fluid along the outer surface of the heat transfer wall is counter to the flow of vaporized liquid along the inner surface of the heat transfer wall so that the hottest part of the heat transfer wall is adjacent the heat conductor disposed downstream of the wick material.

The method further includes delivering a vaporizable liquid to a portion of a wick material that is remote from the heat transfer wall. In a preferred embodiment, the vaporizable liquid comprises water. The wick material conducts the vaporizable liquid from the portion of the wick material that is remote from the heat transfer wall to a portion of the wick material that is in contact with the inner surface of the heat transfer wall. Within this portion of the wick material, heat is readily transferred to the vaporizable liquid heating the vaporizable liquid to its vaporization temperature to produce vaporized liquid. The vaporized liquid evolves from the wick material into spaces e.g. channels, provided by the wick support. When a gas is to be preheated and/or mixed with the vaporized liquid, the gas can be introduced directly into the spaces of the wick support where it is heated and mixed with the vaporized liquid.

The vaporized liquid or mixture of vaporized liquid and gas(es) flows through the wick support and into a superheater section where the vaporized liquid or mixture of vaporized liquid and gas(es) contacts a heat conductor that is in thermal communication with the inner surface of the heat transfer wall. Heat from the inner surface of the heat transfer wall is conducted across an extended surface area of the conductor where it is readily transferred to the vaporized liquid to heat the vaporized liquid to an elevated temperature. As noted above, in a preferred embodiment, a counter flow of heated fluid along the outer surface relative to the flow of vaporized liquid along the inner surface insures that the heat transfer wall is hottest in the region of the heat conductor.

DETAILED DESCRIPTION OF THE FIGURES

As shown in FIG. 1, vaporization apparatus 10 is used to pre-heat a fuel and generate steam for use in reformer 1. Vaporization apparatus 10 receives heat in the form of burner exhaust 6*a* from burner 3. In addition, apparatus 10 receives heat in the form of hot reformate 6*b* from reformer 1. These heat streams are directed into apparatus 10 where they are utilized to produce a mixture 4 of superheated steam and pre-heated fuel that is then directed out of the vaporization apparatus to the reformer. Although not illustrated in detail, water and fuel are provided separately to the vaporization apparatus and are mixed within apparatus 10 after the water is converted to steam. Cooled burner exhaust 7 is directed from the apparatus to vent or downstream use, while the cooled reformate is directed to a fuel cell for use in generating power. Other uses of the hydrogen-rich reformate may be preferred, and thus, fuel cell 5 may be replaced with hydrogen storage or some other hydrogen-consuming device. Further, as is shown in FIG. 1, heat generated by burner 3 can be directed to reformer 1 for use in the fuel reforming process.

Figure 2:
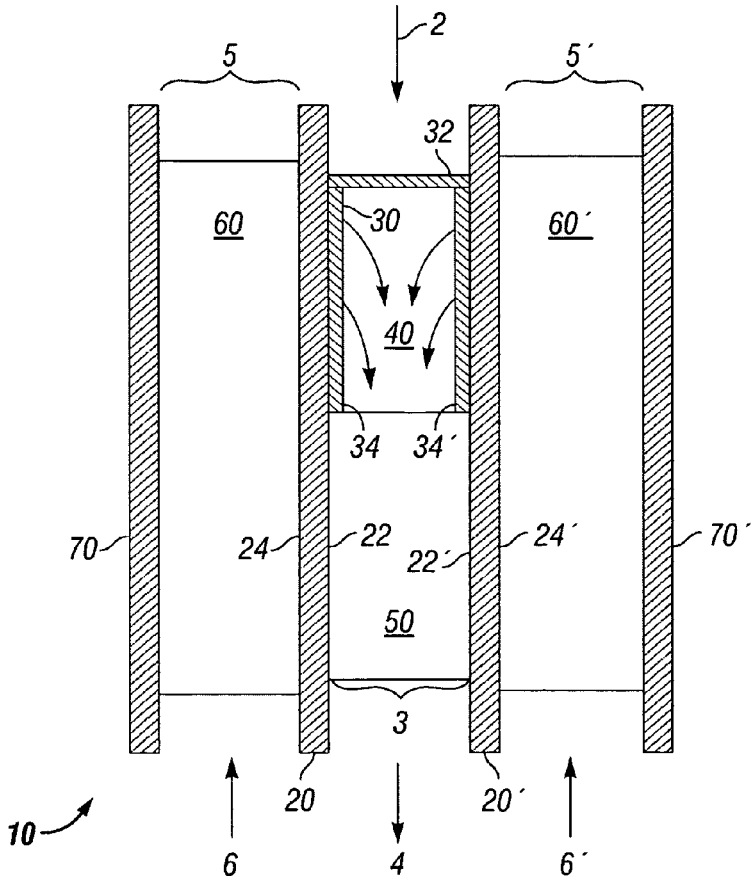
FIG. 2 is a cross sectional view of an apparatus of the present invention.
Figure 4:
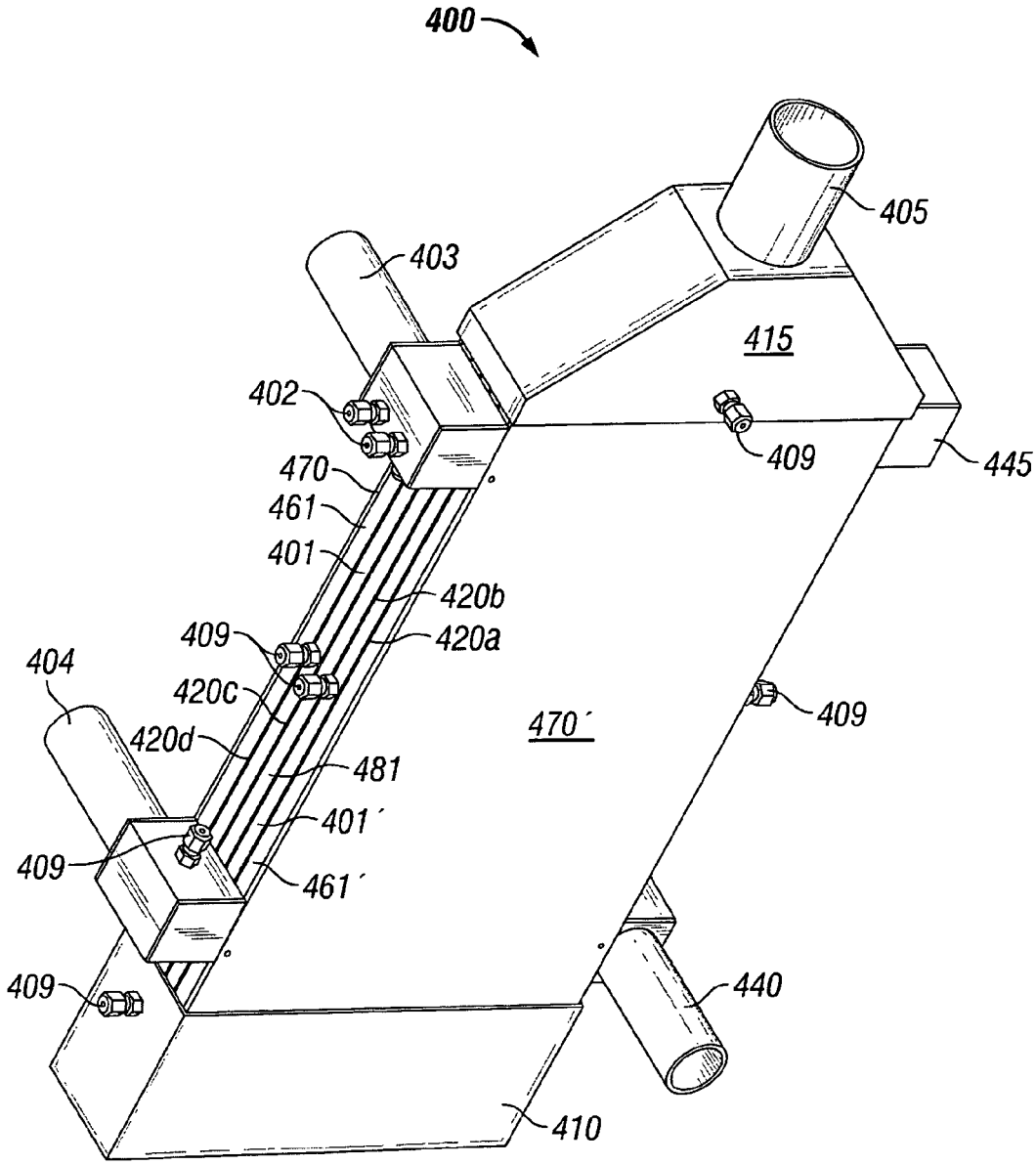
FIG. 4 is a perspective view of an apparatus of the present invention capable of generating a high temperature steam/fuel mixture feed.
Figure 5:
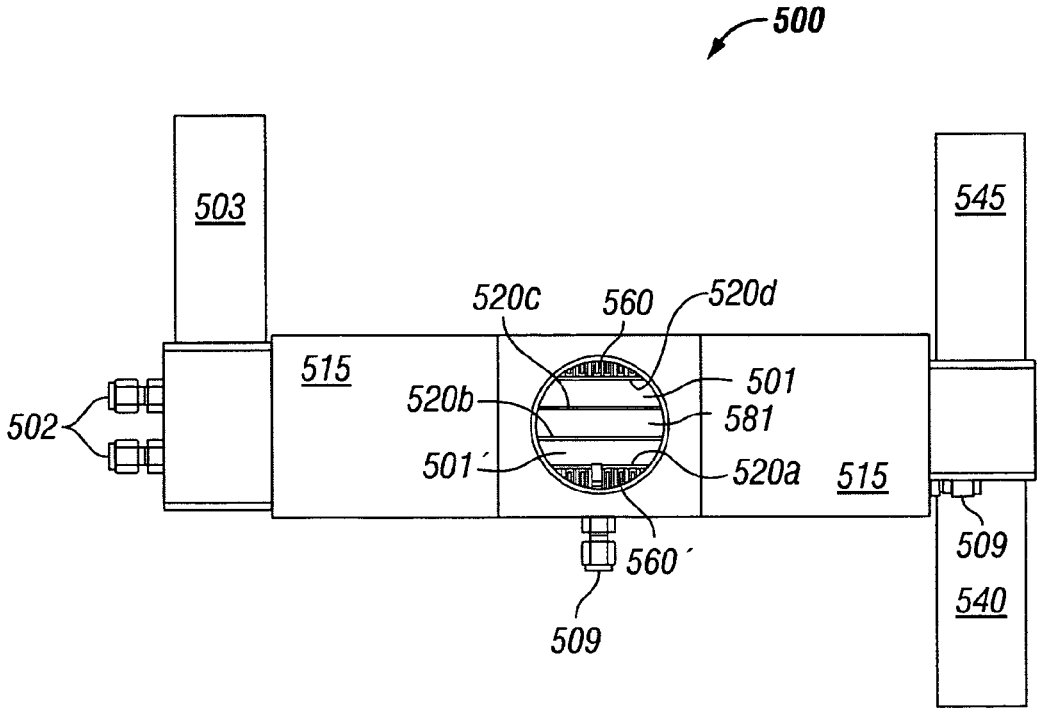
FIG. 5 is a top view of the apparatus shown in FIG. 4.
Figure 6:
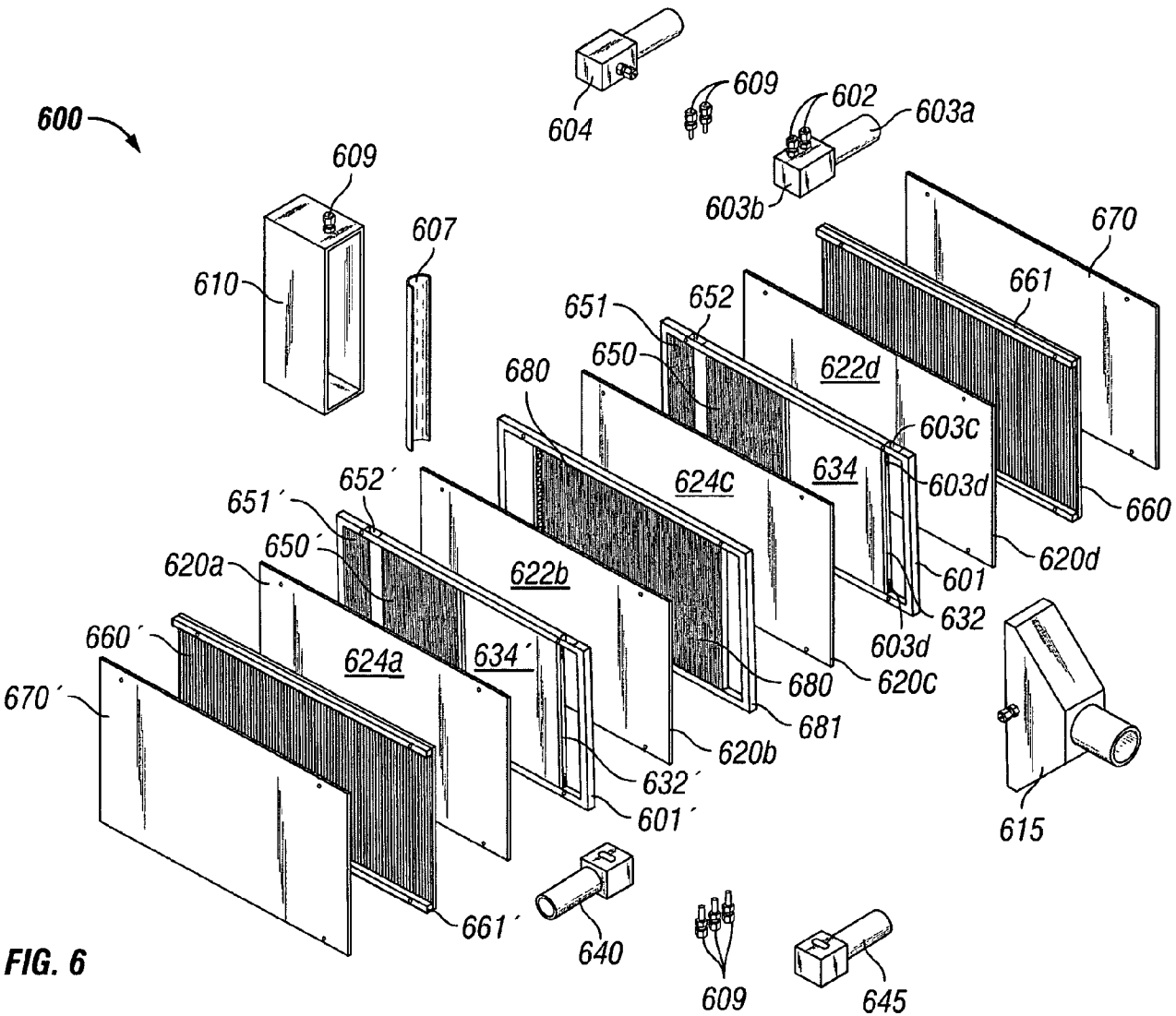
FIG. 6 is an exploded view of the apparatus shown in FIG. 4.

It should be noted that although the vaporization apparatus in FIG. 1 is shown as having three sections, this is merely a generalization for purposes of illustration. As shown in FIG. 2, a vaporization apparatus of the present invention can utilize a single heat source to heat an apparatus having three sections, whereas FIGS. 4–6 illustrate an apparatus that utilizes two heat streams to heat an apparatus having five sections. An advantage of a vaporization apparatus of the present invention is the flexibility to adapt the design of the apparatus to different applications.

FIG. 2 illustrates a vaporization apparatus 10, having a pair of spaced apart planar heat transfer walls 20 and 20' defining a channel 3 therebetween. Heat transfer walls 20 and 20' have inner surfaces 22 and 22' respectively, and outer surfaces 24 and 24' respectively. Disposed within an upstream portion of channel 3 are wick support 40 and wick material 30. Disposed within a downstream portion of channel 3 is heat exchange device 50.

Wick material 30 has side portions 34 and 34' that extend down into the channel and are in contact with upstream portions of inner surfaces 22 and 22' respectively. In addition, wick material 30 has a top portion 32 that is remote from the heat transfer walls and bridges side portions 34 and 34'. Top portion 32 receives a vaporizable liquid from a liquid inlet or liquid delivery means (not shown) and conducts the liquid to side portions 34 and 34' through capillary action and/or siphon effect. Within side portions 34 and 34', the vaporizable liquid receives heat from the inner surfaces 22 and 22' and is heated to its vaporization temperature.

Vaporized liquid evolves from the side portions 34 and 34' of the wick material into the wick support as illustrated by the curved arrows. The vaporized liquid flows into open spaces in the wick support that provide a path for the vaporized liquid to flow out of the upstream portion of channel 3. As illustrated, the wick support is a heat conducting material having an extended surface area, namely corrugated metal fin 40. Corrugated metal fin 40 provides a heat transfer function and serves to maintain contact between leg portions 34 and 34' and the inner surfaces 22 and 22'.

The vaporized liquid flows downstream into a superheater that comprises a heat exchange device, namely corrugated metal fin 50. Corrugated metal fin 50 receives heat from the downstream portion of inner surfaces 22 and 22' and transfers the heat to the vaporized liquid flowing through the fin.

Planar outer walls 70 and 70' are spaced apart from the outer surfaces of heat transfer walls 20 and 20' to define channels 5 and 5' therebetween. Each of channels 5 and 5' houses a heat conductor, specifically, corrugated metal fins 60 and 60', for conducting heat to the outer surfaces 24 and 24' of the heat transfer walls. As illustrated, the flow of vaporized liquid through channel 3 is counter to the flow of heated fluid(s) through channels 5 and 5' enabling the vaporized liquid flowing through corrugated fin 50 to be superheated to an elevated temperature.

Figure 3C:
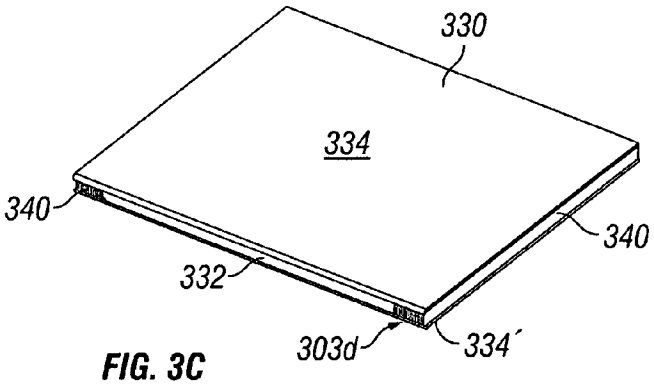
FIG. 3*c* is a perspective view of a wick material overlaying a wick support of the present invention.
Figure 3D:
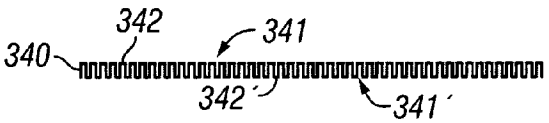
FIG. 3*d* is an end view of a wick support of the present invention.
Figure 3E:
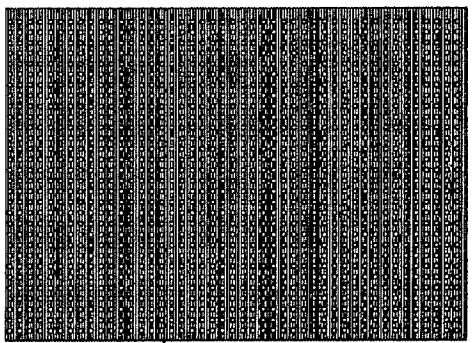
FIG. 3*e* is an elevated view of a wick support of the present invention.
Figure 3A:
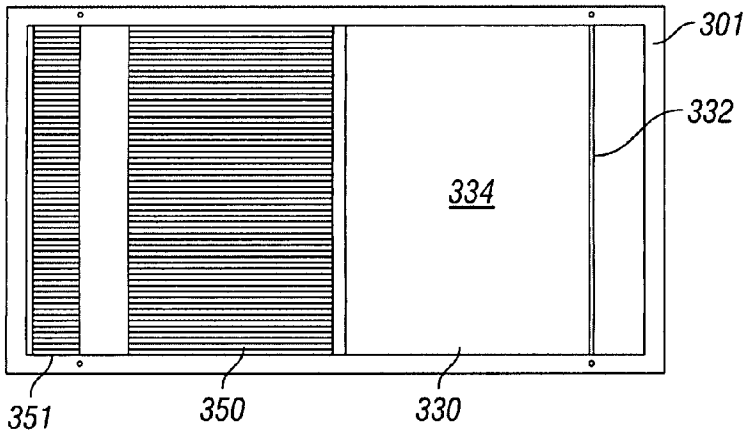
FIG. 3*a* is a detailed view of a wick material and superheater of an apparatus of the present invention.

FIG. 3*a* is an elevated view of the assembled wick material, wick support with superheater in frame 301. A vaporizable liquid to be vaporized is introduced through openings in frame 301 (not shown) so that the liquid contacts top portion 332 of the wick material. During assembly, and as shown in FIG. 3*c*, wick material 330 is folded over corrugated metal fin 340, so that side portions 334 and 334', and top portion 332 are formed. Openings 303*d* can be provided at opposite ends of the top portion 332 so that gas(es) to be pre-heated and mixed with the vaporized liquid may be introduced directly into channels 341 of corrugated metal fin 340. FIGS. 3*d* and 3*e* provide additional views of fin 340 that more clearly detail channels 341. The outer portions 342 an 342' of corrugated fin 340 are in contact with side portions 334 and 334' and insure contact between those side portions and the inner surfaces of the heat transfer wall(s). Channels 341 and 341' provide an extended surface area and paths for the flow of vaporized liquid and other gases through the wick support along the heat transfer wall(s), thereby contributing to the heat transfer function of the wick support.

Figure 3B:
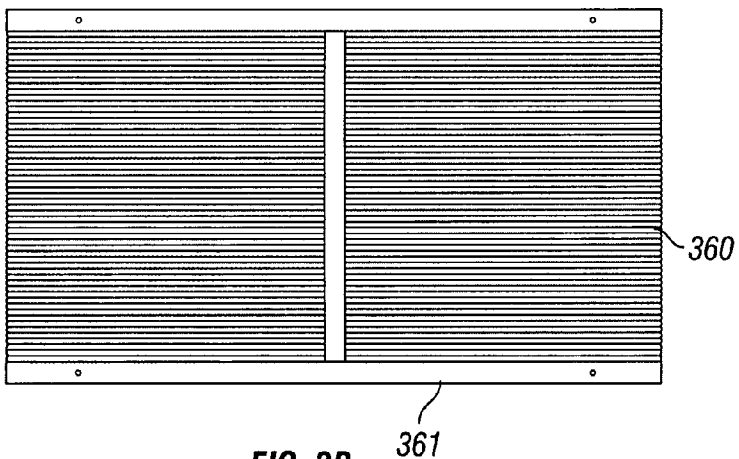
FIG. 3*b* is a detailed view of a heat conductor of an apparatus of the present invention.

The vaporizable liquid is conducted by the wick material from top portion 332 to side portions 334 and 334' where heat from the heat transfer walls vaporizes the liquid. The vaporized liquid evolves into channels 341 and flows down through the superheater that comprises corrugated metal fin 350, where the vaporized liquid is heated to an elevated temperature. The vaporized liquid exits the corrugated metal fin and flows to an outlet provided in frame 301 (not shown). As illustrated, additional heat exchange surface area in the form of corrugated metal fin 351 can be used to provide additional heat transfer surface and structural support for maintaining the shape and rigidity of the device. FIG. 3*b* is an elevated view showing a heat conductor for use in directing heat to the outer surfaces of a heat transfer wall. The heat conductor comprises corrugated metal fin 360 having frame 361.

Framing such as frames 301 and 361 can be used to secure the components in modular-type sections and to facilitate the assembly of an apparatus in a desired configuration. By way of example, the components secured within frame 301 as illustrated in FIG. 3*a* are sometimes referred to herein as a "boiler section" or "boiler channel." The components secured within frame 361 are sometimes referred to herein as a "burner section" or "burner channel" in reference to the fact that corrugated fin 360 and the outer surface of the heat transfer wall can be heated with a flow of burner exhaust.

FIG. 4 shows vaporization apparatus 400 in a configuration for utilizing heat streams from two different heat sources, and for pre-heating a gas and mixing the preheated gas with a vaporized liquid. More specifically, apparatus 400 has burner exhaust inlet manifold 410 for receiving hot burner exhaust and directing it to the burner channels within frames 461 and 461'. Bumer exhaust outlet manifold 415 is provided for directing the cooled burner exhaust from the apparatus. The second heat stream to be utilized by apparatus 400 is hot reformate preferably from a fuel processing reactor. The hot reformate enters apparatus 400 through reformate inlet 440 and passes through the central channel within frame 481. Cooled reformate flows out of the central channel through reformate outlet 445. Vaporizable liquid inlet ports 402 are provided for introducing a vaporizable liquid into the boiler channels framed by frames 401 and 401'. Gas inlet port 403 is provided on an upstream portion of the boiler section so that gas(es) may be introduced into the wick support for pre-heating and mixing with the vaporized liquid. Vapor outlet 404 is provided on a downstream portion of the apparatus for directing the mixture of vaporized liquid and pre-heated gases out of the apparatus.

More particularly, outer walls 470 and 470' enclose the assembly of the five channels or sections of apparatus 400. In order moving from outer wall 470 to outer wall 470' is the burner channel enclosed within frame 461, heat transfer wall 420*d*, the boiler channel within frame 401, heat transfer wall 420*c*, the central channel within frame 481, heat transfer wall 420*b*, the boiler channel within frame 401', heat transfer wall 420*a*, and the burner channel enclosed within frame 461'. In addition, thermocouple ports 409 are provided in multiple locations. The frames, heat transfer walls and outer walls are preferably affixed to one another by brazing while the manifolds, ports and the like are preferably attached by welding. Other means are known in the art for assembling an apparatus of the present invention.

FIG. 5 is an elevated view of the apparatus shown in FIG. 4, from a perspective above the apparatus looking down through the outlet in the burner exhaust outlet manifold 515. Visible through the outlet opening is corrugated metal fin 560, heat transfer wall 520*d*, the boiler channel within frame 501, heat transfer wall 520*c*, the central channel enclosed within frame 581, heat transfer wall 520*b*, the boiler channel enclosed within frame 501', heat transfer wall 520*a*, and corrugated metal fin 560'. Also noted are hot reformate inlet 540 and cooled reformate outlet 545. Vaporizable liquid inlet ports 502 and gas inlet port 503 are likewise shown.

FIG. 6 is an exploded view of the apparatus shown in FIG. 4. Outer walls 670 and 670' enclose an assembly of five channels or sections of apparatus 600. In order moving from outer wall 670 to outer wall 670' is the burner channel enclosed by frame 661, heat transfer wall 620*d*, the boiler channel enclosed within frame 601, heat transfer wall 620*c*, the central channel enclosed within frame 681, heat transfer wall 620*b*, the boiler channel enclosed within frame 601', heat transfer wall 620*a*, and the burner channel enclosed within frame 661'.

As described herein, each of the heat transfer walls have outer and inner surfaces for receiving heat and transferring the heat to a boiler channel, respectively. As illustrated, a heated fluid in the form of burner exhaust enters apparatus 600 through the burner exhaust inlet manifold 610 at located at the bottom of the apparatus. Diverter 607 diverts the flow of the burner exhaust so that it passes upwards through the corrugated fins 660 and 660' where heat is absorbed and conducted to the outer surfaces 624*d* (not shown) and 624*a*. This heat flows through the heat transfer walls to inner surfaces 622*d* and 622*a* (not shown) where it is available for vaporizing the liquid and superheating the vaporized liquid. In addition, a hot reformate enters the apparatus through reformate inlet 640 and flows up through the central channel enclosed by frame 681. The central channel contains corrugated metal fin 680 for conducting the heat of the hot reformate to the outer surfaces 624*c* and 624*b* (not shown). This heat flows through the heat transfer walls to inner surfaces 622*b* and 622*d* (not shown) where it is available for vaporizing the liquid and superheating the vaporized liquid. The streams of cooled reformate and burner exhaust pass through the central and burner channels and exit the apparatus through reformate outlet 645 and burner exhaust outlet manifold 615, respectively.

Vaporizable liquid enters the boiler channels through inlet ports 602 which are in fluid communication with openings 603*c*. During operation, the vaporizable liquid passes through openings 603*c* and onto the top portions 632 and 632' of the respective wick materials. The vaporizable liquid migrates down through the side portions 634 and 634' of the wick material where the liquid is heated and vaporized. The vaporized liquid then flows into the wick support (not shown). Gas(es) introduced through gas inlet port 603*a* enter the boiler channels through openings 603*c* and flow down into the wick support through openings 603*d*. Such gases are preheated and mixed with the vaporized liquid within the corrugated metal fin of the wick support. The mixture of vaporized liquid and pre-heated gases then flows downstream to the superheater section where they are superheated in corrugated metal fins 650 and 650'. The superheated mixture then flows out of the boiler channels through openings 652 and 652' that are in fluid communication with outlet manifold 604.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An apparatus for vaporizing a liquid, the apparatus comprising:

at least one heat transfer wall having an inner surface and an outer surface, the outer surface capable of receiving heat and transferring the heat to the inner surface;

a wick material for receiving a liquid and directing the liquid to the inner surface, at least a portion of the wick material in contact with the inner surface;

a wick support in contact with the wick material opposite the inner surface, the wick support providing a path for a vaporized liquid to flow from the wick material; and a superheater disposed downstream of the wick support, the superheater in fluid communication with the wick support for receiving a vaporized liquid and heating the vaporized liquid to an elevated temperature.

2. The apparatus of claim 1, wherein the portion of the wick material in contact with the inner surface is in contact with an upstream portion of the inner surface.

3. The apparatus of claim 1, wherein the superheater comprises a heat conductor for conducting heat from the inner surface to the vaporized liquid.

4. The apparatus of claim 3, wherein the heat conductor comprises a corrugated metal fin.

5. The apparatus of claim 1, further comprising a heat source for providing heat to the outer surface of the at least one heat transfer wall.

6. The apparatus of claim 5, wherein the heat source is a radiant heat source.

7. The apparatus of claim 5, wherein the heat source comprises one or more of a burner or reforming reactor for providing a flow of heated fluid to the outer surface of the at least one heat transfer wall.

8. The apparatus of claim 1, further comprising a heat conductor in contact with at least a portion of the outer surface opposite the wick material for conducting heat from a heated fluid to the outer surface.

9. The apparatus of claim 8, wherein the heat conductor comprises a corrugated metal fin.

10. The apparatus of claim 1, further comprising at least one outer wall spaced apart from the outer surface and providing a path therebetween for a flow of heated fluid capable of delivering heat to the outer surface.

11. The apparatus of claim 10, wherein the at least one heat transfer wall and the at least one outer wall each comprises a cylindrical wall.

12. The apparatus of claim 1, wherein the at least one heat transfer wall comprises two planar walls spaced apart from one another and wherein the wick support and superheater are disposed between the two planar walls.

13. The apparatus of claim 1, wherein the wick material comprises fibers in a woven or non-woven fabric capable of conducting liquid to the inner surface.

14. The apparatus of claim 13, wherein the fibers comprise alumina.

15. The apparatus of claim 1, wherein the wick support comprises an extended surface area.

16. The apparatus of claim 15, wherein the extended surface area comprises a corrugated metal fin.

17. The apparatus of claim 1, further comprising liquid delivery means for delivering liquid to the wick material, the delivery means comprising a source of liquid and a pump.

18. The apparatus of claim 1, further comprising a vapor outlet in fluid communication with the superheater.

19. An apparatus for vaporizing a liquid, the apparatus comprising:

a plurality of vaporization units, each vaporization unit comprising:

a liquid inlet;

a wick material for receiving a liquid from the liquid inlet and conducting the liquid to a heat transfer wall;

at least one heat transfer wall having an inner surface and an outer surface, the outer surface capable of receiving heat and transferring the heat to the inner surface and at least a portion of the inner surface in contact with the wick material;

a wick support in contact with the wick material opposite the inner surface, the wick support providing a path for a vaporized liquid to flow from the wick material;

a superheater disposed downstream of the wick support, the superheater in fluid communication with the wick support for receiving a vaporized liquid and heating the vaporized liquid to an elevated temperature; and a vapor outlet in fluid communication with the superheater;

a heat source inlet manifold capable of providing a flow of heated fluid to the outer surface of one or more of the vaporization units; and an outlet manifold capable of directing the flow of heated fluid out of the one or more vaporization units.

20. The apparatus of claim 19, further comprising a second heat source inlet manifold capable of providing a flow of a second heated fluid to one or more of the vaporization units and a second outlet manifold capable of directing the flow of the second heated fluid out of the one or more vaporization units.

21. The apparatus of claim 19, further comprising liquid delivery means capable of delivering liquid to the liquid inlets, the liquid delivery means comprising a source of liquid, a pump, and metering means for delivering a uniform flow of liquid to the liquid inlets.

22. A method for making an apparatus for vaporizing a liquid, the method comprising the steps of:

overlaying a wick material over at least an upstream portion of a wick support having an extended surface area;

placing a heat conductor adjacent a downstream portion of the wick support; and enclosing the wick support, wick material and heat conductor with at least one heat transfer wall having an inner surface and an outer surface, a portion of the wick material in contact with an upstream portion of the inner surface and the heat conductor adjacent a downstream portion of the inner surface.

23. The method of claim 22, further comprising one or more of the following steps:

selecting an anticipated flow rate at which the wick material is to receive a vaporizable liquid;

providing a wick material capable of receiving an anticipated flow of vaporizable liquid remote from the at least one heat transfer wall and conducting the vaporizable liquid to a portion of the wick material in contact with the at least one heat transfer wall;

selecting material(s) for the at least one heat transfer wall wick material and/or wick support that will provide a heat transfer coefficient capable of transferring sufficient heat from the outer surface to the inner surface to vaporize an anticipated flow of vaporizable liquid so that non-vaporized liquid is prevented from contacting the heat conductor; and providing sufficient contact area between the wick material and the inner surface to vaporize an anticipated flow of vaporizable liquid so that non-vaporized liquid is prevented from contacting the heat conductor.

24. The method of claim 22, further comprising the step of disposing a second heat conductor adjacent the outer surface of the at least one heat transfer wall.

25. The method of claim 22, further comprising the step of providing an opening in the wick material for introducing a gas into the wick support.

26. A method for vaporizing a liquid, the method comprising the steps of:

providing heat to an outer surface of a heat transfer wall, the heat transfer wall capable of transferring heat from the outer surface to an inner surface for vaporizing a vaporizable liquid and for heating a vaporized liquid to an elevated temperature;

delivering a vaporizable liquid to a portion of a wick material remote from the heat transfer wall, the wick material conducting the vaporizable liquid to a portion of the wick material in contact with the inner surface of the heat transfer wall where the vaporizable liquid is heated to produce a vaporized liquid; and contacting the vaporized liquid with a heat conductor in thermal communication with the inner surface of the heat transfer wall to heat the vaporized liquid to an elevated temperature.

27. The method of claim 26, wherein heat is provided to the outer surface of the heat transfer wall in sufficient quantity to vaporize the vaporizable liquid and prevent non-vaporized liquid from contacting the heat conductor.

28. The method of claim 26, wherein the outer surface of the heat transfer wall is heated by one or more of contact with a flow of heated fluid and/or receiving heat from a radiant heat source.

29. The method of claim 28, wherein the flow of heated fluid comprises one or more of burner exhaust and/or hot reformate.

30. The method of claim 28, wherein the flow of heated fluid along the heat transfer wall is counter to the flow of vaporized liquid.

31. The method of claim 26, wherein the vaporizable liquid comprises water.

32. The method of claim 26, further comprising the step of mixing a fuel with the vaporized liquid to provide a mixture of heated fuel and vaporized liquid.

33. The method of claim 32, wherein the fuel is mixed with the vaporized liquid by introducing the fuel directly into the wick support.

* * * * *